United States Patent [19]

Barriac

[11] Patent Number: 4,726,482

[45] Date of Patent: Feb. 23, 1988

[54] TAMPER INDICATING PACKAGE AND MOLDED PLASTIC CLOSURE THEREFOR

[75] Inventor: Jacques J. Barriac, Toledo, Ohio

[73] Assignee: Owens-Illinois Closure Inc., Toledo, Ohio

[21] Appl. No.: 30,531

[22] Filed: Mar. 27, 1987

[51] Int. Cl.[4] ..... B65D 41/34

[52] U.S. Cl. ..... 215/252; 215/307

[58] Field of Search ..... 215/252, 307

[56] References Cited

U.S. PATENT DOCUMENTS

| | | | |
|---|---|---|---|
| 3,966,071 | 6/1976 | Northup | 215/307 X |
| 4,007,851 | 2/1977 | Walker | 215/307 |
| 4,401,227 | 8/1983 | Pehr | 215/252 |
| 4,427,126 | 1/1984 | Ostrowsky | 215/307 |
| 4,572,388 | 2/1986 | Luker et al. | 215/252 |

*Primary Examiner*—Donald F. Norton

[57] ABSTRACT

A package including a container with a threaded finish and a molded plastic closure that is sealingly applied to the finish. The closure has a skirt portion, and the skirt portion has one or more apertures in it, at a location or locations near the top of the closure. Adjacent each aperture in the skirt portion of the closure the closure has a flexible tab which is frangibly attached to the skirt portion and which extends inwardly and upwardly from the skirt portion to engage a radially projecting bead on the finish of the container, at a location above the thread on the finish of the container. Upon the first removal or attempted removal of the closure from the container, each flexible tab is broken away from the skirt portion of the closure by the flexible tab with the radially projecting bead on the closure finish, and this damage to the closure is visible through the aperture that the flexible tab is near to provide a visual indication of the possible tampering with the package or its contents. Further, when the package is used to contain a carbonated beverage or other pressurized product, each aperture in the skirt portion of the closure aids in the venting of the headspace of the container, to thereby inhibit the misseling of the closure during its removal.

36 Claims, 9 Drawing Figures

Fig-1
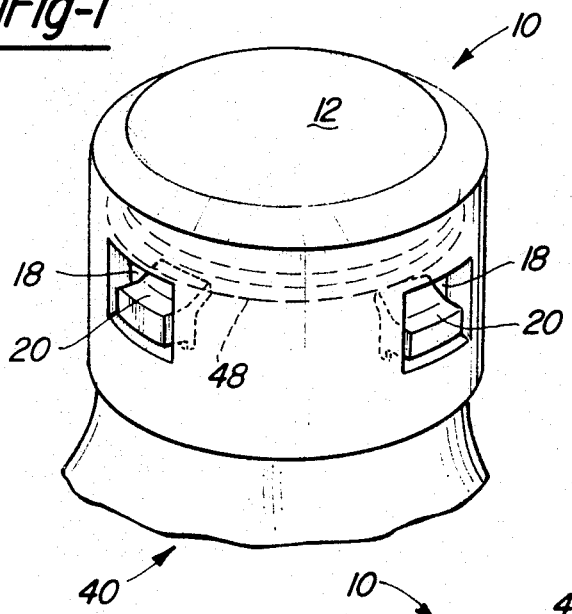
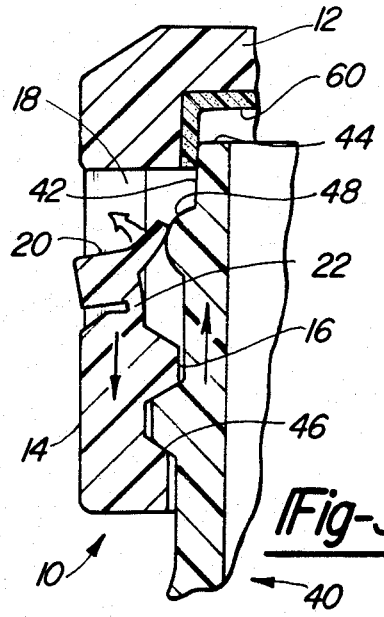
Fig-3
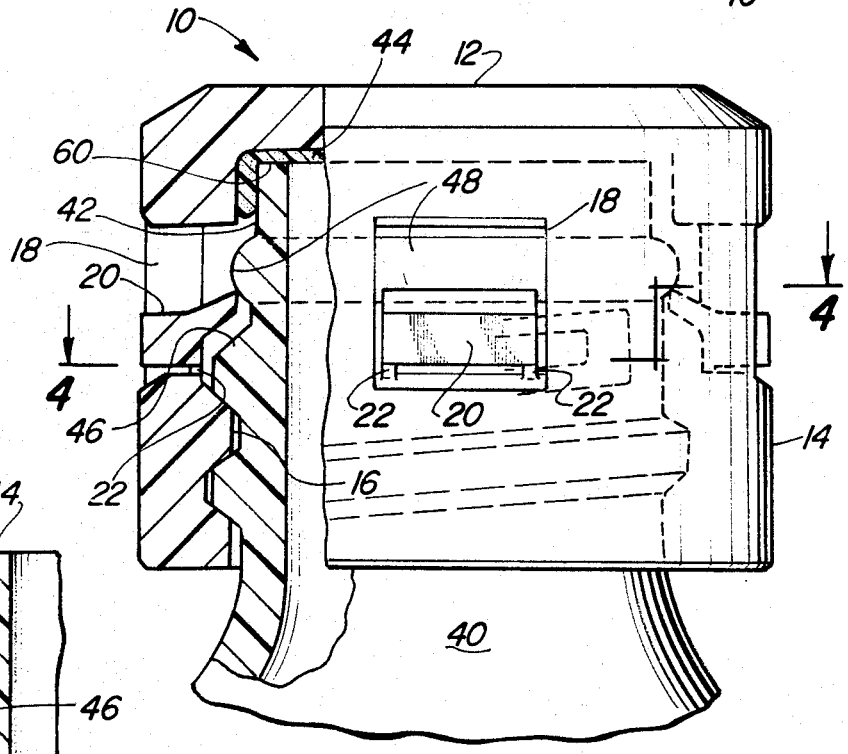
Fig-2
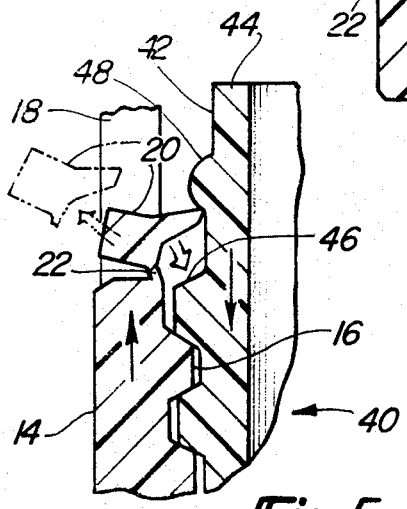
Fig-5

TAMPER INDICATING PACKAGE AND MOLDED PLASTIC CLOSURE THEREFOR

BACKGROUND OF THE INVENTION

1. Field Of The Invention

This invention relates to a tamper indicating package and to a molded plastic closure for use in such package. More particularly, this invention relates to a tamper indicating package for the packaging of a carbonated beverage, and to a venting molded plastic closure for such a package.

2. Description Of The Prior Art

Various prior art references, including U.S. Pat. No. 4,530,437 (T. W. Gray et al.), U.S. Pat. No. 4,550,844 (M. A. Lininger), and U.S. Pat. No. 4,613,052 (J. L. Gregory et al.), each of which is assigned to the assignee of this application, and U.S. Pat. No. 4,401,227 (H. T. Pehr) disclose packages with molded plastic closures. Each of the molded plastic closures of these references includes a portion or portions that is or are visibly and irreparably damaged upon the first removal or attempted removal of the closure from the associated container to provide a visible indication of such removal or attempted removal, as a way of providing an indication of any prior tampering with the contents of the container. In each of the above-identified prior art references, the portion of the closure that is visibly and irreparably damaged upon the first removal or attempted removal of the closure from the associated container is located at or near the bottom of the skirt portion of such closure. Thus, in the aforesaid U.S. Pat. No. 4,530,437, the closure includes a separate band, a portion of which engages a flange on the associated container, and another portion of which engages the lower portion of the annular skirt of the closure. Upon the removal of the closure by an unscrewing action, the separate band separates from the closure to provide the requisite indication of the removal or the attempted removal of the closure. In the above-identified U.S. Pat. No. 4,550,844, the annular skirt of the closure has an annular tamper indicating band integrally attached to the lowermost edge thereof by means of a plurality of frangible bridges, and the band has a plurality of inwardly and upwardly extending tabs that engage the underside of an annular flange on the neck of the container to prevent the removal of the annular band with the closure. The removal of the closure results in the fracture of the frangible bridges and, thereby, the separation of the annular band from the closure. In the aforesaid U.S. Pat. No. 4,401,227, the closure is provided with spaced apart inwardly and upwardly extending tabs near the bottom of the annular skirt of the closure, which tabs, themselves, are disengaged from the closure upon the removal or attempted removal of the closure from the container. In each of the aforesaid prior art closures, the portion or portions of the closure that separate from the remaining portion of the closure upon the removal or attempted removal of the closure are located at or near the bottom of the annular skirt of the closure, and this feature is somewhat objectionable because of the fact that it is difficult to maintain the required tolerances and sharp radii in the portion or the portions of the finish of the associated container which engage such portion or portions of the closure, particularly in the case of a glass container, at the required distances of such portion or portions of the closure from the rim of the container Further, in the case of a closure that is intended for the use in the packaging of a carbonated beverage product, it is desirable to provide venting passages within the closure to augment the depressurization of the headspace of the container upon the removal of the closure, as a way to prevent misseling of the closure from the container during removal, as is explained in U.S. Pat. No. 4,427,126 (E. M. Ostrowsky). For simplicity of construction, it is desirable to integrate the headspace venting passages of the closure with the tamper indicating features of the closure, and, thus, it is desirable to provide the tamper indicating features of the closure at or near the top of the closure, rather than at or near the bottom of the closure, to shorten the flow path for the gases from the headspace of the container through the venting passages of the closure, and to thereby accelerate the venting phenomenon.

SUMMARY OF THE INVENTION

According to the present invention there is provided a molded plastic closure which is provided with a circumferential series of spaced apart frangible tabs that extend inwardly and upwardly from the closure skirt at locations near the top of the closure. After the closure has been affixed to the finish of a container, the tabs engage a continuous tamper bead on the finish of the container, the tamper bead on the container finish being positioned above the helical thread on the container finish, and close to the rim of the container, a position which facilitates the manufacture of the tamper bead of the container finish since it easier to maintain the requisite tolerances and sharp radii in the tamper bead on the container when it is positioned close to the rim of the container, as opposed to being positioned distant from the rim of the container. The closure according to the present invention is well-suited for use in the packaging of carbonated beverages, because the tamper-indicating tabs, which break away from the closure upon the first removal or attempted removal of the closure from the container, are provided in the skirt of the closure at locations close to rather than distant from the rim of the container for maximum effectiveness in the venting of the container headspace, to thereby help to inhibit the misseling of the closure from the container. Further, the placement of the tamper indicating tabs of the closure of the present invention at locations close to the top of the closure, rather than at or near the bottom of the annular skirt of the closure, is desirable in closures which are applied by means of a chuck capper, since such placement of the tamper indicating tabs results in the tabs being protected from damage during capping by the capping chuck itself. In the case of a closure according to the present invention which is to be used in the packaging of a carbonated beverage or other liquid, such closure may be readily provided with a separate sealing liner on the underside of the top panel thereof, such liner being adapted to seal the finish of the associated container both on the top and for a finite distance along the side of the finish, to provide a top and side seal closure, for the type of sealing effectiveness that is desirable in the packaging of a pressurized liquid such as a carbonated beverage.

Accordingly, it is an object of the present invention to provide an improved tamper indicating, molded plastic closure. More particularly, it is an object of the present invention to provide a tamper indicating molded plastic closure which is suitable for use in the packaging of a liquid product. Specifically, it is an object of the present invention to provide a lined, tamper indicating molded plastic closure which is suitable for use in the packaging of carbonated beverage products in glass or plastic containers, the tamper indicating features of the closure also serving to facilitate the venting of the headspace of the associated container during the removal of the closure as an anti-misseling feature. It is also an object of the present invention to provide a package that includes a glass or plastic container which is securely closed by means of a tamper indicating molded plastic closure according to the present invention. For a further understanding of the present invention and the objects thereof, attention is directed to the drawing and the following brief description thereof, to the detailed description of the preferred embodiment and to the appended claims.

BRIEF DESCRIPTION OF THE DRAWING

FIG. 1 is a fragmentary elevational perspective view of a preferred embodiment of a molded plastic closure according to the present invention, as applied to the finish of a container;

FIG. 2 is a fragmentary elevational view, partly in section, further illustrating the assembled relationship between the closure and the container of FIG. 1;

FIG. 3 is a fragmentary elevational view, in section, showing a step in the application of the closure of FIG. 1 to the container of FIG. 1;

FIG. 5 is a fragmentary elevational view, in section, showing a step in the removal of the closure of FIG. 1 from the container of FIG. 1;

DETAILED DESCRIPTION OF THE PREFERRED EMBODIMENT

Figure 4:
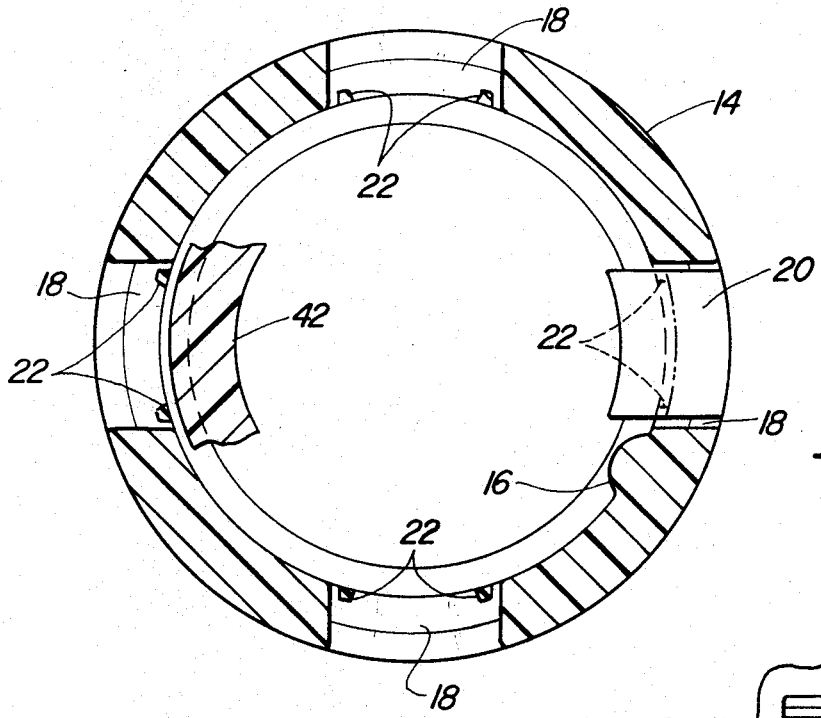
FIG. 4 is a sectional view taken on line 4—4 of FIG. 2.

As is shown in FIG. 1 and 2, a closure according to the present invention is indicated generally by the reference numeral 10, and is shown in the closing position on a container which is shown fragmentarily and which is indicated generally by the reference numeral 40. The container 40 is of a type which is suitable for the packaging of a pressurized product, such a carbonated beverage product or a malt beverage product, and is provided with a neck or finish portion 42. The finish portion 42 of the container 40 terminates in a rim 44 and is provided with an outwardly projecting and helically extending thread 46 for a purpose which will be hereinafter explained more fully. Containers such as the container 40 are typically made either of glass or of a suitable thermoplastic material, such as polyethylene terephthlate (PET), and most of such containers are manufactured with a 28 millimeter finish diameter, that is, with a "T" dimension, the diameter at the outside of the container thread 46, of approximately 28 millimeters. The finish 42 of the container 40 is also provided with an outwardly projecting annular bead 48 at an elevation between the rim 44 and the uppermost portion of the helical thread 46, and the function of the annular bead 48 will be hereinafter described.

The closure 10 is molded in a single piece and is comprised of a top panel portion 12 which is generally horizontally disposed, in the orientation of the closure that is shown in FIGS. 1 and 2, and which spans the mouth of the container 40, and a vertically depending annular skirt portion 14 which extends downwardly from the top panel portion 12. The annular skirt portion 14 of the closure 10 surrounds at least the upper portion of the finish portion 42 of the container 40, including the thread 46, and the annular skirt portion 14 is provided with an inwardly projecting and helically extending thread 16 which is engageable with the thread 46 of the container 40 to permit the closure 10 to be applied to the container 40 by a screwing on action and to be removed from the container 40 by an unscrewing action. Of course, it also contemplated that the present invention is adaptable to a closure which is applied to the associated container by a snapping action or by a push and turn action involving a bayonet-type arrangement, and even to a multiple thread start helical thread arrangement, all of which are known in the art.

To facilitate the sealing of the closure 10 to the finish 42 of the container 40, a sealing liner 60 is inserted into the closure 10 prior to the application of the closure 10 to the container 40. The sealing liner 60, which, preferably, is formed in a single piece from a sheet of a soft, rubbery thermoplastic material, such as polyvinyl chloride, has sufficient extent to cover all of the underside of the top panel portion 12 of the closure 10 as well as a finite portion of the inside of the annular skirt portion 14 which is disposed adjacent to the top panel portion 12. Thus, the sealing liner 60 is of the type which engages the rim 44 of the container 40 as well as a circumferentially endless portion of the finish portion 42 of the container 40 adjacent to the rim 44, so that, when the closure 10 is tightly applied to the finish portion 42 of the container 40, the container 40 will be sealed both against the top and the side of the finish portion 42. The seal between the closure 10, the container 40 and the sealing liner 60, which is sometimes described as a top and side seal, is a suitable sealing technique for use in the packaging of a carbonated beverage or other internally pressurized product. However, in the packaging of a still or non-pressurized product, for example, in the packaging of a fruit juice or a non-carbonated fruit-flavored beverage, a smaller sealing liner 60 maybe used, since, in such a packaging application, it is usually only necessary to seal against the rim of the associated container. Further, it is contemplated that, in the packaging of various still or unpressurized liquids, the sealing liner 60 may be omitted by the use of a self-sealing or linerless closure design, for example, as is shown in U.S. Pat. No. 3,255,909 (I. H. Miller), a construction which has been popular for closures used in the packaging of distilled spirits.

The annular skirt portion 14 of the closure 10 is provided with at least one, and preferably four, apertures 18 extending therethrough, each such aperture 18, preferably, being generally rectangular in configuration. Where more than one of such apertures 18 is utilized, they are, preferably, equidistantly spaced around the circumference of the annular skirt portion 14, i.e., when four of such apertures are used, as illustrated, each such aperture is located 90 degrees from the adjacent apertures. Each aperture 18 is positioned between the thread 16 of the closure 10 and the top panel portion 12 of the closure 10, and, in the case of a closure 10 that is intended for use in conjunction with a container for the packaging of a pressurized liquid, at least a major portion of each such aperture 18 is positioned below the level of the periphery of the sealing liner 60, to permit each such aperture to serve to vent the headspace of the container 40 upon the removal of the closure 10 from the container 40, as a way to help to prevent the misseling of the closure 10 from the container 40 during removal. The closure 10 is also provided with at least one, preferably four, flexible tabs 20, each of which is positioned adjacent to, and preferably at least partly within, one of the apertures 18, as illustrated in the drawing. Each flexible tab 20 is frangibly attached to annular skirt portion 14 of the closure 10, preferably, at a location along the bottom side of the rectangular aperture 18 which such flexible tab 20 is adjacent to, and, as is shown in FIGS. 2 and 3, each such flexible tab 20 is connected to the annular skirt portion 14 by means of a pair of spaced apart frangible bridges 22 which extend between the bottom side of the flexible tab 20 and the bottom edge of the aperture 18. Each flexible tab 20 extends inwardly and upwardly from the annular skirt portion 14 of the closure 10, and has.a tip portion that engages the underside of the annular bead 48 of the container 40 when the closure 10 is securely affixed to the finish portion 42 of the container 40. Thus, upon the first removal or attempted removal of the closure 10 from the container 40, each flexible tab 20 will be ruptured from the annular skirt portion 14 of the closure 10 by the rupturing of the frangible bridges 22 which connect such flexible tab 20 to the annular skirt portion 14, as a result of the loadings that are developed within such frangible bridges 22 by the interference between the tip portion of the flexible tab 20 and the annular bead 48 of the container 40, as is shown most clearly in FIG. 5. This rupturing of each of the flexible tabs 20 from the annular skirt portion 14 of the closure 10 is visually detectable by virtue of the fact that each of such flexible tabs 20 is positioned adjacent to an aperture 18, through which such flexible tab 20 is visible. Thus, a consumer or a retail store employee can readily determine whether any given closed package has previously been opened or subjected to an opening attempt, and this is a way of preventing the consumption of the contents of a container after any tampering with such contents.

Due to the flexibility of the flexible tab 20, which results, at least in part, from the fact that the closure 10 is molded from a thermoplastic material, and due to the inward and upward orientation of each such flexible tab 20, each flexible tab 20 can normally be deflected out of the way by the annular bead 48 of the container 40 during the application of the closure 10 to the container 40, without rupturing or irreparably damaging the frangible bridges 22 during such application of the closure 10, as is illustrated in FIG. 3 of the drawing.

Closures corresponding to the closure 10 can be mass-produced from a suitable thermoplastic material on a relatively inexpensive basis by injection molding or compression molding. In the illustrated embodiment such closures are produced by a process in which they are stripped from the associated mold tooling. Thus, such closures must be produced from a thermoplastic material which has sufficient flexibility to be strippable from mold tooling. Suitable materials include high density polyethylene, polypropylene and flexible polyesters and copolyesters, including, of course, various additives such as plasticizers and colorants.

Figure 6:
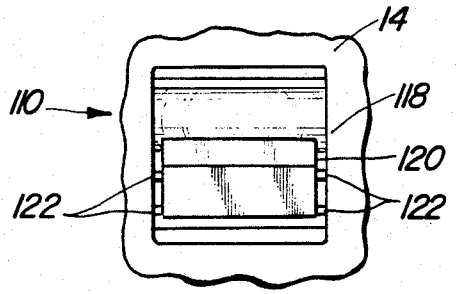
FIG. 6 is a fragmentary elevational view showing a portion of an alternative embodiment of a closure according to the present invention.
Figure 7:
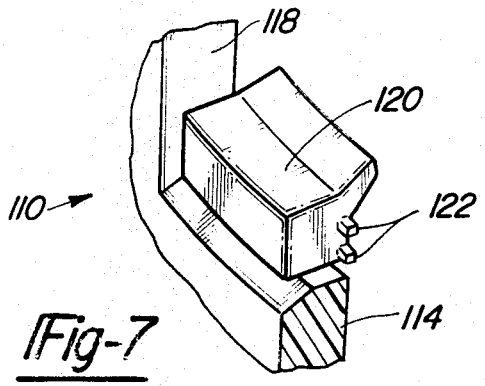
FIG. 7 is a fragmentary elevational perspective view, partly in section, showing a portion of the closure of FIG. 6.

FIGS. 6 and 7 illustrate a modified flexible tab 120 which is attached to the annular skirt portion 114 of a molded plastic closure 110 at locations along the sides of the rectangular aperture 118 by means of a pair of spaced apart frangible bridges 122. The flexible tab 120 of the embodiment of FIGS. 6 and 7 has less flexibility than the flexible tab 20 of the embodiment of FIGS. 1 through 5, and, thus, the flexible tab 120 is more assuredly separated from its closure during the removal of the closure than is the flexible tab 20.

Figure 8:
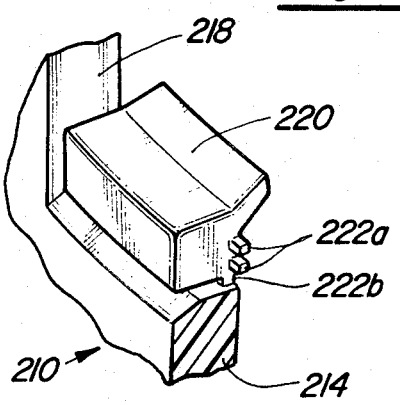
FIG. 8 is a view similar to FIG. 7 showing another alternative embodiment of the closure according to the present invention.

FIG. 8 illustrates a modified flexible tab 220 which is attached to the annular skirt portion 214 of a molded plastic closure 210 at locations both along the sides of the rectangular aperture 218 by means of a pair of spaced apart frangible bridges **222*a*, and along the bottom of the rectangular aperture 218 by one or more frangible bridges 222*b*. The flexible tab 220 of the embodiment of FIG. 8 has even less flexibility than the flexible tab 120 of the embodiment of FIGS. 6 and 7, and, thus, the flexible tab 220 is even more assuredly separated from its closure during the removal of the closure than is the flexible tab 120**.

Figure 9:
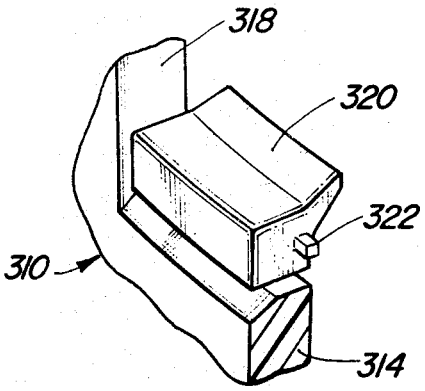
FIG. 9 is view similar to FIGS. 7 and 8 showing yet another alternative embodiment of the closure of the present invention.

FIG. 9 illustrates a modified flexible tab 320 which is attached to the annular skirt portion 314 of a molded plastic closure 310 at a location along each of the sides of the rectangular aperture 318 by a single frangible bridge 322 on each side of the flexible tab 320. The flexible tab 328 of the embodiment of FIG. 9, thus, has more flexibility than the flexible tab 20 of the embodiment of FIGS. 1 through 5, and is more assuredly not inadvertantly separated from its closure during the application of the closure to a container than is the closure 20.

Although the best mode contemplated by the inventor for carrying out the present invention as of the filing date hereof has been shown and described herein, it will be apparent to those skilled in the art that suitable modifications, variations, and equilvalents may be made without departing from the scope of the invention, such scope being limited solely by the terms of the following claims.

What is claimed is:

1. A removable, tamper indicating closure for engaging the finish portion of a container, the finish portion of the container terminating in a rim and including closure engaging means and annular bead means positioned between the rim and the closure engaging means, said closure comprising, in combination:

a top portion adapted to span the finish of the container; and an annular skirt extending downwardly from said top portion and being adapted to surround an upper portion of the finish portion of the container including the rim and the closure engaging means, said annular skirt including;

finish engaging means extending radially inwardly from said annular skirt for removably engaging the closure engaging means of the finish of the container, at least one aperture in said annular skirt, said at least one aperture being positioned between said finish engaging means and said top portion of said closure; and flexible tab means frangibly attached to said. annular skirt and extending inwardly and upwardly from a location adjacent said at least one aperture, said flexible tab means being visible through said at least one aperture, being adapted to engage the annular bead means of the container, and being separable from said closure upon the first attempt to remove said closure from the container.

2. A tamper indicating closure according to claim 1 wherein said top portion and said annular skirt are formed integrally with one another in one piece from a thermoplastic material.

3. A tamper indicating closure according to claim 2 wherein said one piece is formed by a process that is selected from the group consisting of injection molding processes and compression molding processes.

4. A tamper indicating closure according to claim 3 wherein said thermoplastic material has a major ingredient which is selected from the group consisting of high density polyethylene, polypropylene, and flexible polyesters and copolyesters.

5. A tamper indicating closure according to claim 1 wherein the closure engaging means of the container comprises helical thread means, and wherein said finish engaging means of said annular skirt of said closure comprises second helical thread means whereby said closure may be applied to the finish of the container by a screwing action and removed from the finish of the container by an unscrewing action.

6. A removable tamper indicating closure for engaging the finish portion of a container, the finish portion of the container terminating in a rim and including closure engaging means and annular bead means positioned between the rim and the closure engaging means, said closure comprising, in combination:

a top portion adapted to span the finish of the container; and an annular skirt extending downwardly from said top portion and being adapted to surround an upper portion of the finish of the container including the rim and the closure engaging means, said annular skirt including;

finish engaging means extending radially inwardly from said annular skirt for securely engaging the closure engaging means of the finish container;

a plurality of spaced apart apertures in said annular skirt, each aperture in said plurality of apertures being positioned between said finish engaging means and said top portion of said closure, and a plurality of spaced apart flexible tabs, each of the flexible tabs in said plurality of spaced apart flexible tabs being frangibly attached to said annular skirt and extending inwardly and upwardly from said annular skirt at a location adjacent one of said plurality of spaced apart apertures, said each of the flexible tabs being visible through said one of said plurality of spaced apart apertures, being adapted to engage the annular bead means of the container, and being separable from said closure upon the first attempt to remove said closure from the container.

7. A tamper indicating closure according to claim 6 wherein said plurality of spaced apart apertures in said annular skirt comprises four apertures, each of the apertures in said four apertures being approximately 90° arcuately spaced from the adjacent apertures in said four apertures, and wherein said plurality of spaced apart flexible tabs comprises four flexible tabs, each of the flexible tabs in said four flexible tabs being approximately 90° arcuately spaced from the adjacent flexible tabs in said four flexible tabs.

8. A tamper indicating closure according to claim 6 wherein said top portion and said annular skirt are formed integrally with one another in one piece from a thermoplastic material.

9. A tamper indicating closure according to claim 8 wherein said one piece is formed by a process that is selected from the group consisting of injection molding processes and compression molding processes.

10. A tamper indicating closure according to claim 9 wherein said thermoplastic material has a major ingredient which is selected from the group consisting of high density polyethylene, polypropylene, and flexible polyesters and copolyesters.

11. A tamper indicating closure according to claim 7 wherein the closure engaging means of the container comprises helical thread means, and wherein said finish engaging means of said annular skirt of said closure comprises second helical thread means, whereby said closure may be applied to the finish of the container by a screwing action and removed from the finish of the container by an unscrewing action.

12. A removable tamper indicating closure for sealingly engaging the finish portion of a container for the packaging of a liquid product, the finish portion of the container terminating in a rim and including closure engaging means and annular bead means positioned between the rim and the closure engaging means, said closure comprising, in combination:

a top portion adapted to span the finish portion of a container, said top portion having an underside;

sealing liner means positioned against said underside of said top portion of said closure, said sealing liner means being adapted to be squeezed in an endless pattern between said underside of said top portion of said closure and at least the rim of the finish portion of the container to form a liquid tight seal between said closure and the finish of the container; and an annular skirt extending downwardly from said top portion, said annular skirt surrounding said sealing liner means and being adapted to surround an upper portion of the finish portion of the container including the rim and the closure engaging means, said annular skirt including;

finish engaging means extending radially inwardly from said annular skirt for securely engaging the closure engaging means of the finish of the container;

a plurality of spaced apart apertures in said annular skirt, each aperture in said plurality of apertures being positioned between said finish engaging means and said sealing liner means; and a plurality of spaced apart flexible tabs, each of the flexible tabs in said plurality of spaced apart flexible tabs being frangibly attached to said annular skirt and extending inwardly and upwardly from said annular skirt at a location adjacent one of said plurality of spaced apart apertures, said each of the flexible tabs being visible through said one of said plurality of spaced apart apertures, being adapted to engage the annular bead means of the container, and being separable from said closure upon the first attempt to remove said closure from the container.

13. A tamper indicating closure according to claim 12 wherein said plurality of spaced apart apertures in said annular skirt comprises four apertures, each of the apertures in said four apertures being approximately 90° arcuately spaced from the adjacent apertures in said four apertures, and wherein said plurality of spaced apart flexible tabs comprises four flexible tabs, each of the flexible tabs in said four flexible tabs being approximately 90° arcuately spaced from the adjacent flexible tabs in said four flexible tabs.

14. A tamper indicating closure according to claim 12 wherein said top portion and said annular skirt are formed integrally with one another in one piece from a thermoplastic material.

15. A tamper indicating closure according to claim 14 wherein said one piece is formed by a process that is selected from the group consisting of injection molding processes and compression molding processes.

16. A tamper indicating closure according to claim 15 wherein said thermoplastic material has a major ingredient which is selected from the group consisting of high density polyethylene, polypropylene, and flexible polyesters and copolyesters.

17. A tamper indicating closure according to claim 13 wherein the closure engaging means of the container comprises helical thread means, and wherein said finish engaging means of said annular skirt of said closure comprises second helical thread means, whereby said closure may be applied to the finish of the container by a screwing action and removed from the finish of the container by an unscrewing action.

18. A removable, anti-misseling, tamper indicating closure for sealingly engaging the finish portion of a container for the packaging of a pressurized liquid product and for venting the container during the removal of said closure from the finish portion, the finish portion of the container having an annular side portion, the annular side portion terminating in a rim, the finish portion further including closure engaging means and annular bead means positioned between the annular side portion of the finish portion rim and the closure engaging means, said closure comprising, in combination:

a top portion adapted to span the finish portion of a container, said top portion having an underside;

an annular skirt having an inside with an upper portion and extending downwardly from said top portion, said annular skirt being adapted to surround an upper portion of the finish portion of the container including the rim and the closure engaging means, said annular skirt including;

finish engaging means extending radially inwardly from said inside of said annular skirt below said upper portion for securely engaging the closure engaging means of the finish of the container;

a plurality of spaced apart apertures in said annular skirt, each aperture in said plurality of apertures being positioned between said finish engaging means and said upper portion of said inside surface, each of said plurality of spaced apart apertures being adapted to provide a path for venting the container during the removal of said closure from the container, and a plurality of spaced apart flexible tabs, each of the flexible tabs in said plurality of spaced apart flexible tabs being frangibly attached to said annular skirt and extending inwardly and upwardly from said annular skirt at a location adjacent one of said plurality of spaced apart apertures, said each of the flexible tabs being visible through said one of said plurality of spaced apart apertures, being adapted to engage the annular bead means of the container when said closure engages the finish portion of the container, and being separable from said closure upon the first attempt to remove said closure from the container; and sealing liner means partly positioned against said underside of said top portion of said closure and partly positioned against said upper portion of said inside of said annular skirt of said closure, said sealing liner means being adapted to be squeezed in an endless pattern between said underside of said top portion of said closure and the rim of the finish portion of the container and in an endless pattern between said upper portion of said inside of said annular skirt of said closure and the annular side portion of the finish portion of the container to form a pressure sustaining liquid tight top and side seal between said closure and the finish of the container.

19. A tamper indicating closure according to claim 18 wherein said plurality of spaced apart apertures in said annular skirt comprises four apertures, each of the apertures in said four apertures being approximately 90° arcuately spaced from the adjacent apertures in said four apertures, and wherein said plurality of spaced apart flexible tabs comprises four flexible tabs, each of the flexible tabs in said four flexible tabs being approximately 90° arcuately spaced from the adjacent flexible tabs in said four flexible tabs.

20. A tamper indicating closure according to claim 19 wherein said top portion and said annular skirt are formed integrally with one another in one piece from a thermoplastic material.

21. A tamper indicating closure according to claim 20 wherein said one piece is formed by a process that is selected from the group consisting of injection molding processes and compression molding processes.

22. A tamper indicating closure according to claim 21 wherein said thermoplastic material has a major ingredient which is selected from the group consisting of high density polyethylene, polypropylene, and flexible polyesters and copolyesters.

23. A tamper indicating closure according to claim 19 wherein the closure engaging means of the container comprises helical thread means, and wherein said finish engaging means of said annular skirt of said closure comprises second helical thread means, whereby said closure may be applied to the finish of the container by a screwing action and removed from the finish of the container by an unscrewing action.

24. A package comprising, in combination:

a container having a finish portion, said finish portion terminating in a rim and including closure engaging means and annular bead means positioned between said rim and said closure engaging means; and a closure sealingly engaging said finish portion of said container, said closure being removable from said container and comprising;

a top portion spanning said finish of said containers, and an annular skirt extending downwardly from said top portion and surrounding an upper portion of said finish portion of said container, including said rim, and said closure engaging means, said annular skirt including;

finish engaging means extending radially inwardly from said annular skirt, said finish engaging means being in removable engagement with said closure engagement means of said finish of said container, at least one aperture in said annular skirt, said at least one aperture being positioned between said finish engaging means and said top portion of said closure, and flexible tab means frangibly attached to said annular skirt and extending inwardly and upwardly from a location adjacent said at least one aperture, said flexible tab means being visible through said at least one aperture being in engagement with said annular bead means of said container, and being separable from said closure upon the first attempt to remove said closure from said container.

25. A package according to claim 24 wherein said top portion and said annular skirt of said closure are formed integrally with one another in one piece from a thermoplastic material.

26. A package according to claim 24 wherein said container is formed from glass.

27. A package according to claim 24 wherein said closure engaging means of said finish of said container comprises helical thread means, and wherein said finish engaging means of said annular skirt of said closure comprises second helical thread means, whereby said closure may be removed from said container by an unscrewing action.

28. A package comprising, in combination:

a container having a finish portion, said finish portion terminating in a rim and including closure engaging means and annular bead means positioned between said rim and said closure engaging means; and a closure sealingly engaging said finish portion of said container, said closure being removable from said container and comprising;

a top portion spanning said finish of said containers, and an annular skirt extending downwardly from said top portion and surrounding an upper portion of said finish portion of said container, including said rim, and said closure engaging means, said annular skirt including;

finish engaging means extending radially inwardly from said annular skirt, said finish engaging means being in removable engagement with said closure engagement means of said finish of said container, a plurality of spaced apart apertures in said annular skirt, each aperture in said plurality of apertures being positioned between said finish engaging means and said top portion of said closure; and a plurality of spaced apart flexible tabs, each of the plurality of spaced apart flexible tabs being frangibly attached to said annular skirt and extending inwardly and upwardly from said annular skirt at a location adjacent one of said plurality of spaced apart apertures, being in engagement with said annular bead means of said container, and being separable from said closure upon the first attempt to remove said closure from said container.

29. A package according to claim 28 wherein said plurality of spaced apart apertures in said annular skirt of said closure comprises four apertures, each of the apertures in said four apertures being approximately 90° arcuately spaced from the adjacent apertures in said four apertures, and wherein said plurality of spaced apart flexible tabs comprises four flexible tabs, each of the flexible tabs in said four flexible tabs being approximately 90° arcuately spaced from the adjacent flexible tabs in said four flexible tabs.

30. A package according to claim 28 wherein said top portion and said annular skirt of said closure are formed integrally with one another in one piece from a thermoplastic material.

31. A package according to claim 28 wherein said container is formed from glass.

32. A package according to claim 28 wherein said closure engaging means of said finish of said container comprises helical thread means, and wherein said finish engaging means of said annular skirt of said closure comprises second helical thread means, whereby said closure may be removed from said container by an unscrewing action.

33. A package comprising, in combination:

a container for the packaging of a liquid product having a finish portion, said finish portion terminating in a rim and including closure engaging means and annular bead means positioned between said rim and said closure engaging means; and a tamper indicating closure sealingly engaging said finish portion of said container, said closure being removable from said container and comprising;

a top portion spanning said finish of said containers, said top portion having an underside; and sealing liner means positioned against said underside of said top portion of said closure, said sealing liner means being squeezed in an endless pattern between said underside of said top portion of said closure and at least said rim of said finish portion of said container to form a liquid tight seal between said closure and said finish of said container; and an annular skirt extending downwardly from said top portion and surrounding an upper portion of said finish portion of said container, including said rim, and said closure engaging means, said annular skirt including;

finish engaging means extending radially inwardly from said annular skirt, said finish engaging means being in removable engagement with said closure engagement means of said finish of said container, at least one aperture in said annular skirt, said at least one aperture being positioned between said finish engaging means and said top portion of said closure, and flexible tab means frangibly attached to said annular skirt and extending inwardly and upwardly from a location adjacent said at least one aperture, said flexible tab means being visible through said at least one aperture being in engagement with said annular bead means of said container, and being separable from said closure upon the first attempt to remove said closure from said container.

34. A package according to claim 33 wherein said top portion and said annular skirt of said closure are formed integrally with one another in one piece from a thermoplastic material.

35. A package according to claim 33 wherein said container is formed from glass.

36. A package according to claim 33 wherein said closure engaging means of said finish of said container comprises helical thread means, and wherein said finish engaging means of said annular skirt of said closure comprises second helical thread means, whereby said closure may be removed from said container by an unscrewing action.

* * * * *